US008176890B2

(12) United States Patent
Sugiyama

(10) Patent No.: US 8,176,890 B2
(45) Date of Patent: May 15, 2012

(54) ENGINE OIL PAN STRUCTURE

(75) Inventor: Norifumi Sugiyama, Shizuoka-ken (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 808 days.

(21) Appl. No.: 12/316,239

(22) Filed: Dec. 10, 2008

(65) Prior Publication Data

US 2009/0151690 A1 Jun. 18, 2009

(30) Foreign Application Priority Data

Dec. 17, 2007 (JP) ..... 2007-324494

(51) Int. Cl.
*F02F 7/00* (2006.01)

(52) U.S. Cl. ..... 123/195 C; 184/106

(58) Field of Classification Search ..... 123/192.2, 123/195 R, 195 C; 184/106
See application file for complete search history.

(56) References Cited

U.S. PATENT DOCUMENTS 5,743,230 A * 4/1998 Yamazaki et al. ..... 123/195 H
6,131,543 A * 10/2000 Achenbach et al. ..... 123/195 C

FOREIGN PATENT DOCUMENTS

JP 62-43161 3/1987

* cited by examiner

*Primary Examiner* — Noah Kamen
(74) *Attorney, Agent, or Firm* — Flynn, Thiel, Boutell & Tanis, P.C.

(57) ABSTRACT

An engine oil pan structure includes a lower case having a pair of side walls and a plurality of bearing cap sections for connection between the side walls. A balancer device provided under the lower case, mounts on a mounting section formed at positions of the bearing cap section adjoining the side walls. An oil pan covering the balancer device is joined to lower end portions of the side walls. A reinforcing rib having a horseshoe-shaped form and surrounding the balancer device is provided on an external surface of the oil pan, and two end portions of the reinforcing rib are joined or monolithic with portions of a flange section for joining the oil pan to the side walls adjoining the mounting section to reduce noise of an engine having a balancer device.

5 Claims, 7 Drawing Sheets

ENGINE OIL PAN STRUCTURE

FIELD OF THE INVENTION

The present invention relates to an engine oil pan structure, and more specifically to an engine oil pan structure for suppressing vibrations of side walls of a lower case and side walls of the oil pan to reduce noises generated by the engine.

BACKGROUND OF THE INVENTION

Generally, an oil pan is provided in a lower portion of an engine and functions as a storage section for lubricating oil that is supplied to various sections of the engine for lubrication.

For an engine having a lower case, the lower case is attached under a cylinder block, and the oil pan is attached to a lower portion of the lower case.

Some types of engines based on the conventional technology have a configuration in which a lower case having a pair of side walls and a bearing cap section for connection between the two side walls is attached to a lower portion of a cylinder block. Further, a balancer device having a balancer shaft is attached to the bearing cap section.

In this configuration, the bearing cap section vibrates in the longitudinal direction of a crank shaft in association with vibration of the balancer device in the longitudinal direction of a cylinder when the engine is driven. The vibrations of the bearing cap section are delivered to side walls of a lower case connected to the bearing cap or side walls of an oil pan joined to a lower end portion of the lower case to disadvantageously cause an increase of engine noise.

On the other hand, it is generally known, as disclosed in Japanese utility Model Registration Laid-Open Publication No. SHO 62-43161, that a rib for suppression of vibrations or noises is provided in the oil pan.

However, the conventional type of rib has the disadvantage that the rib can not sufficiently suppress vibrations delivered from a balancer device to a lower case.

When a rib is formed on an external side face of the oil pan, it is possible to suppress vibrations and noises. Provision of a rib on an external side face of the oil pan, however, disadvantageously leads to increase of size and/or weight of the oil pan, which makes it impossible to provide engine components around the oil pan.

An object of the present invention is to efficiently reduce noises generated by an engine with a balancer device attached to a bearing cap section.

SUMMARY OF THE INVENTION

According to the invention, there is provided an oil pan structure including a lower case having a pair of side walls, each extending in a longitudinal direction of a crank shaft, and a plurality of bearing cap sections for connection between the side walls. The lower case is provided under a cylinder block. A balancer device having a balancer shaft is provided under the lower case and mounted on a mounting section formed at positions of the bearing cap section adjoining the side walls, respectively. An oil pan that covers the balancer device is joined to lower end portions of the side walls of the bearing cap sections. The oil pan structure is characterized by a reinforcing rib having a horseshoe-shaped form. The reinforcing rib surrounding the balancer device is provided on an external surface of the oil pan and two end portions of the reinforcing rib are joined to portions of a flange section for joining the oil pan to the side walls adjoining the mounting section.

As described in detail above, the present invention provides an oil pan structure comprising: a lower case having a pair of side walls each extending in a longitudinal direction of a crank shaft, and a plurality of bearing cap sections for connection between the side walls. The lower case is provided under a cylinder block. A balancer device having a balancer shaft is provided under the lower case and mounted on a mounting section formed at positions of the bearing cap section adjoining the side walls, respectively. An oil pan covering the balancer device is joined to lower end portions of the side walls. The oil pan structure, that includes a reinforcing rib having a horseshoe-shaped form for surrounding the balancer device, is provided on an external surface of the oil pan. Two end portions of the reinforcing rib are joined to portions of a flange section for joining the oil pan to the side walls adjoining the mounting section.

In the present invention, since a reinforcing rib having a horseshoe-shaped form and surrounding the balancer device is provided on an external surface of the oil pan, and two end portions of the reinforcing rib are joined to portions of a flange section for joining the oil pan to the side walls adjoining the mounting section, flange sections of the oil pan facing each other with the balancer device in between and adjoining input points of vibrations are joined to each other with the reinforcing rib. Thus noises generated by the engine can be reduced by suppressing vibrations of the side walls of the lower case and the side walls of the oil pan.

In addition, because the reinforcing rib is formed on an external face of the oil pan, it is possible to reduce a surface area of the oil pan by reducing a depth of the oil pan provided in a lower portion of the balancer device. Thus noises generated by the engine in association with vibration of side walls of the oil pan can be reduced.

DETAILED DESCRIPTION

Figure 1:
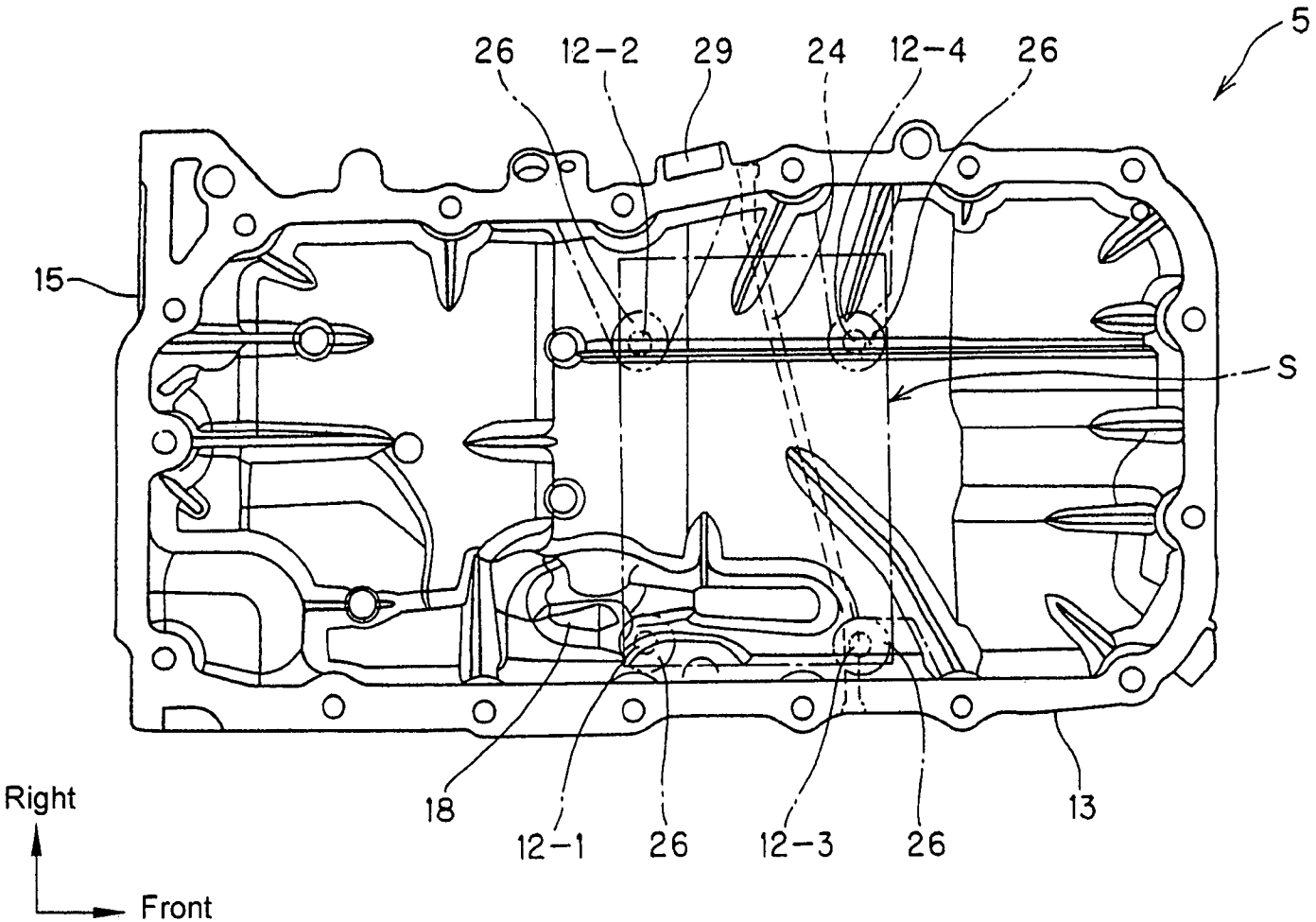
FIG. 1 is a top view illustrating the interior of an oil pan according to an embodiment of the present invention.
Figure 2:
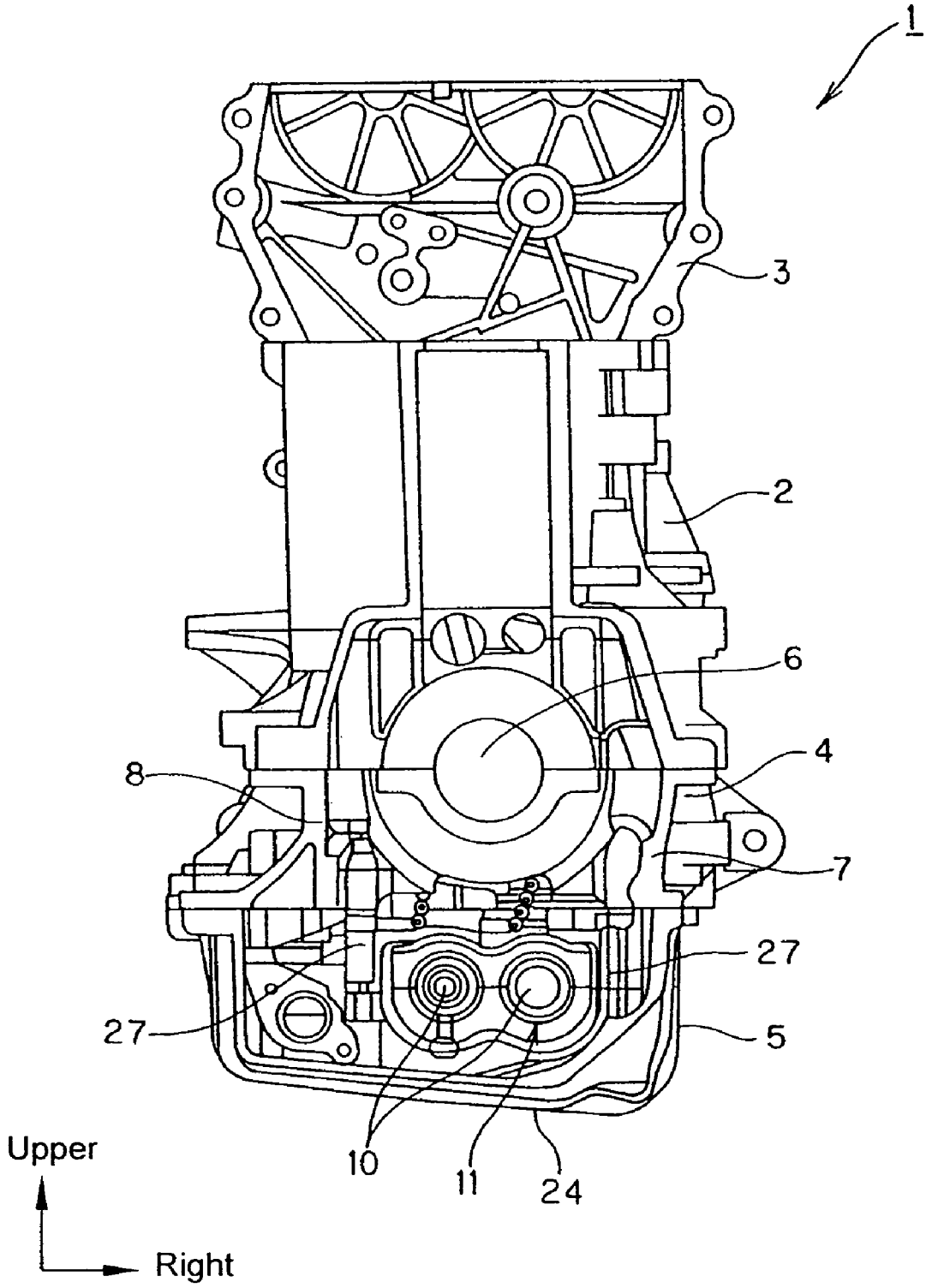
FIG. 2 is a general cross-sectional view illustrating an engine taken along the line 2-2 in FIG. 4.

FIG. 1 to FIG. 7 show an embodiment of the present invention. As shown in FIG. 2, an engine 1 comprises a cylinder block 2, a cylinder head 3 which is attached to an upper portion of the cylinder block 2, a lower case 4 which is attached to a lower portion of the cylinder block 2, and an oil pan 5 which is attached to a lower portion of the lower case 4.

Figure 6:
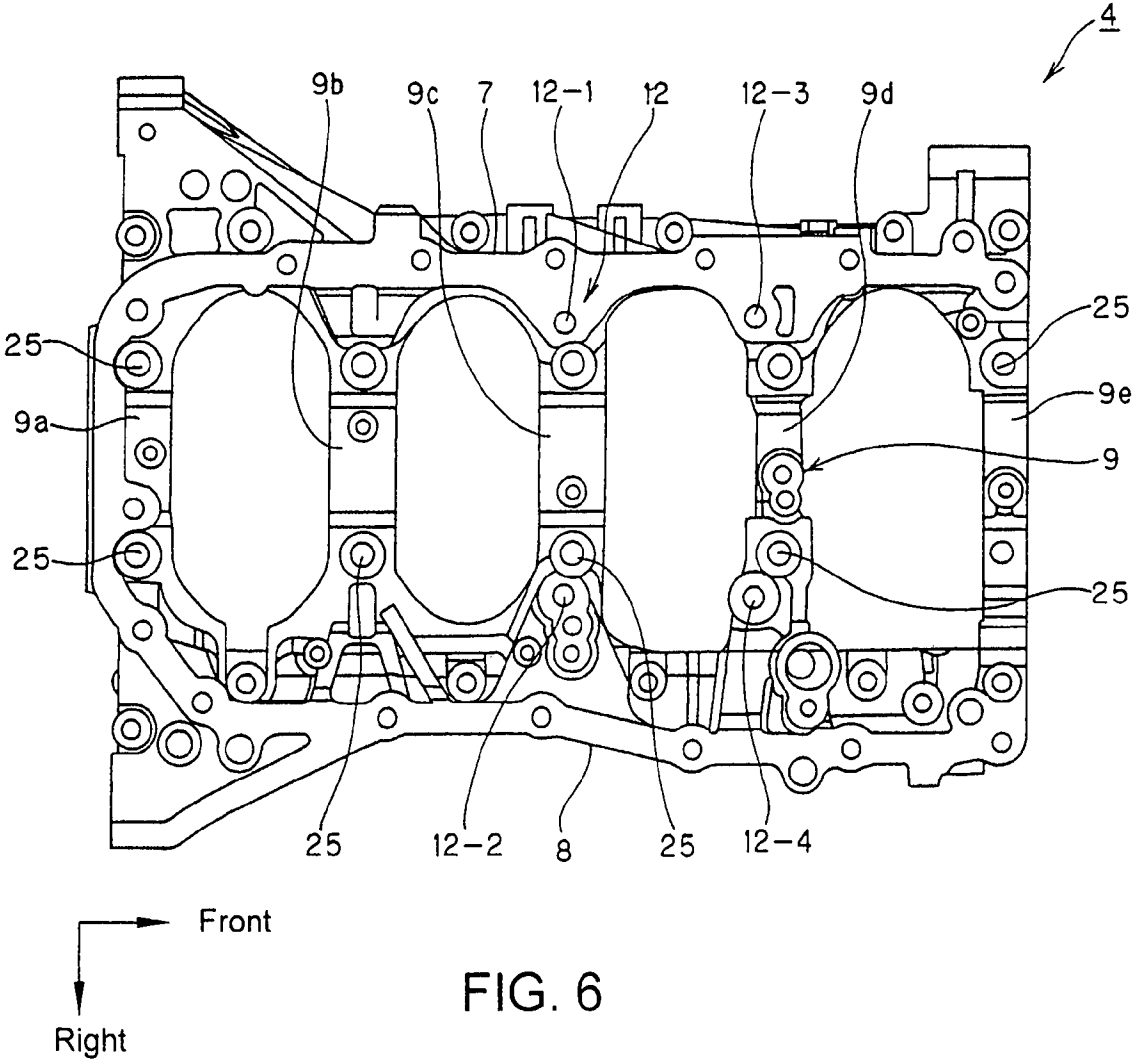
FIG. 6 is a bottom view of a lower case.

In this configuration, as shown in FIG. 2 and FIG. 6, the lower case 4 comprises a pair of first and second side walls 7, 8 extending in parallel to the longitudinal direction of the crank shaft 6, and a plurality of bearing cap sections 9 for connection between the first and second side walls 7, 8.

Furthermore, a balancer device 11 having a balancer shaft 10 is provided under the lowercase 4 as shown in FIG. 2. This balancer device 11 is attached to a mounting section 12 of the lower case 4.

In this configuration, as shown in FIG. 6, the mounting section 12 is formed at a position where the mounting section 12 adjoins the first and second side walls 7, 8 of the bearing cap section 9.

The oil pan 5 covering the balancer device 11 is joined to lower portions of the first and second side walls 7 and 8.

As shown in FIG. 1, FIG. 3, FIG. 5 and FIG. 7, the oil pan 5 has a form or shape like a tank having a horseshoe-shaped cross section, and has a flange section 13 formed on an upper external periphery of the oil pan 5. Furthermore, a plurality of joining sections 14 are formed on this flange section 13.

Figure 3:
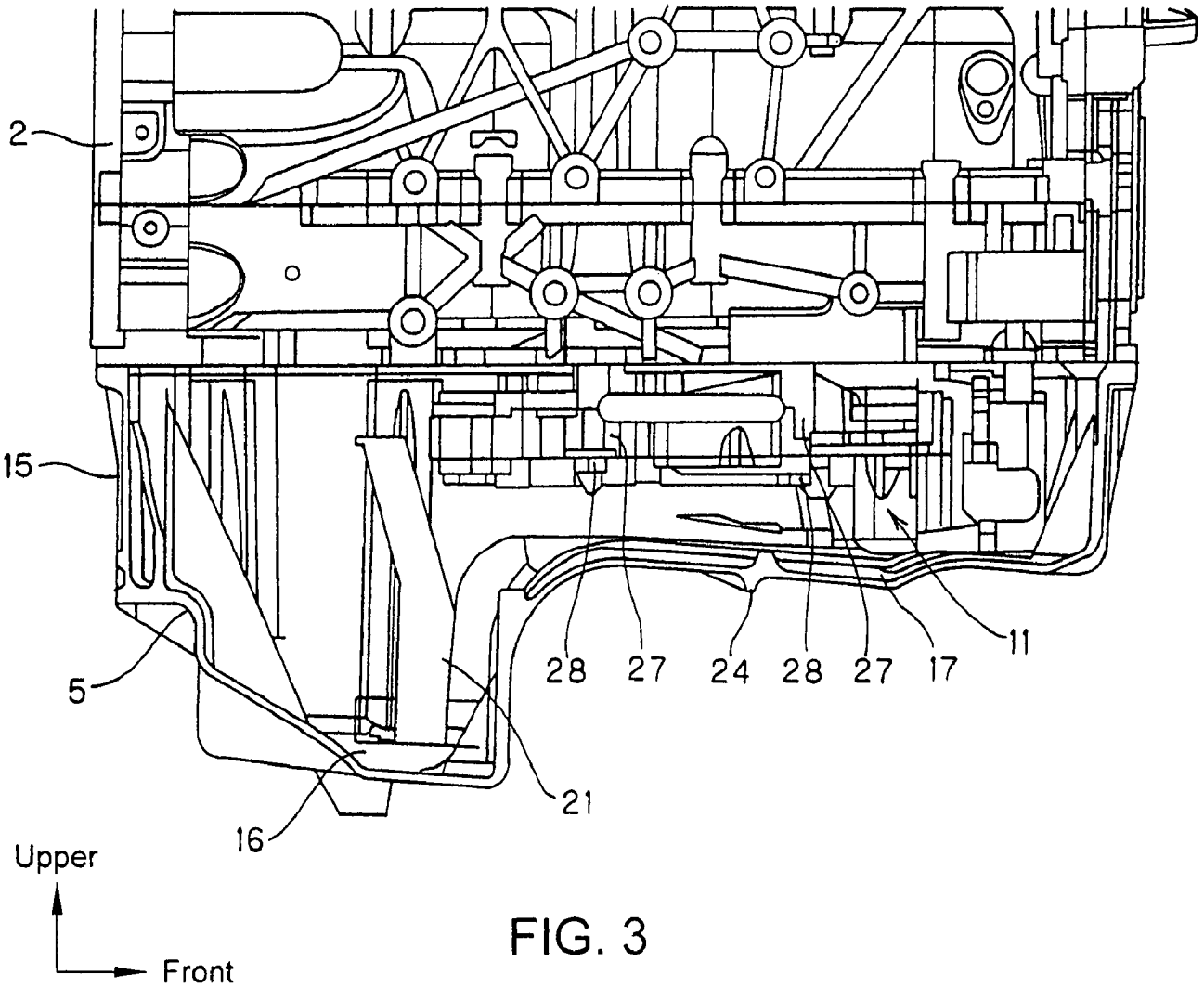
FIG. 3 is a lateral cross-sectional view of the oil pan.
Figure 7:
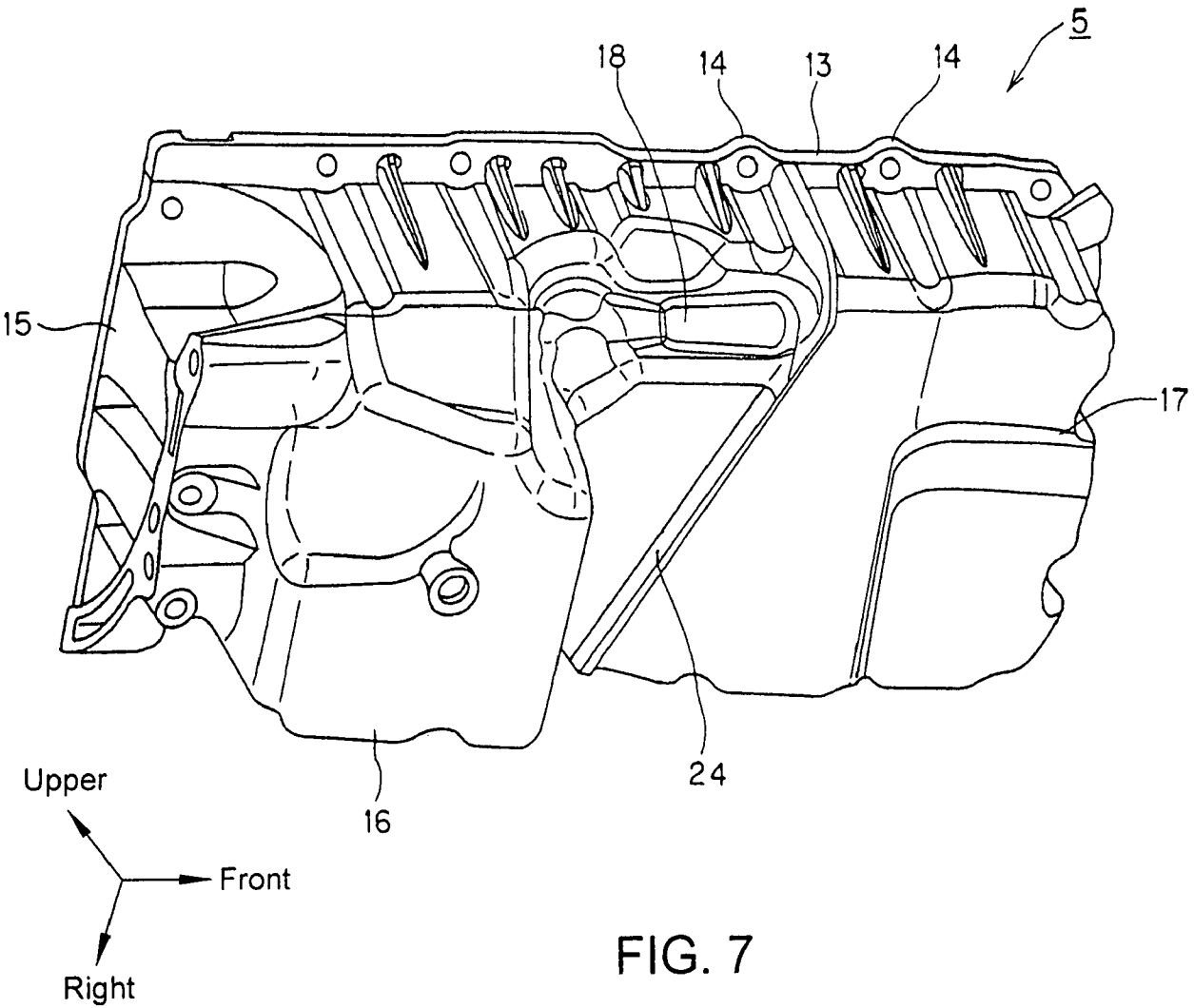
FIG. 7 is a perspective view illustrating the oil pan viewed from a diagonally lower position.

In addition, a transmission joining section 15 is formed at the side face of the oil pan 5 as shown in FIG. 1, FIG. 3, FIG. 5, and FIG. 7 (at the left side in FIG. 3 and FIG. 7).

In the oil pan 5 shown in FIG. 3 and FIG. 7, a deep bottom section 16 with the vertical dimension larger than that in the horizontal direction is formed at a side of the oil pan 5 (at the left side in FIG. 3 and FIG. 7). Also a shallow bottom section 17 with the horizontal dimension larger than that in the vertical direction is formed at another side of the oil pan 5 (shown at the right side in FIG. 3 and FIG. 7).

Figure 5:
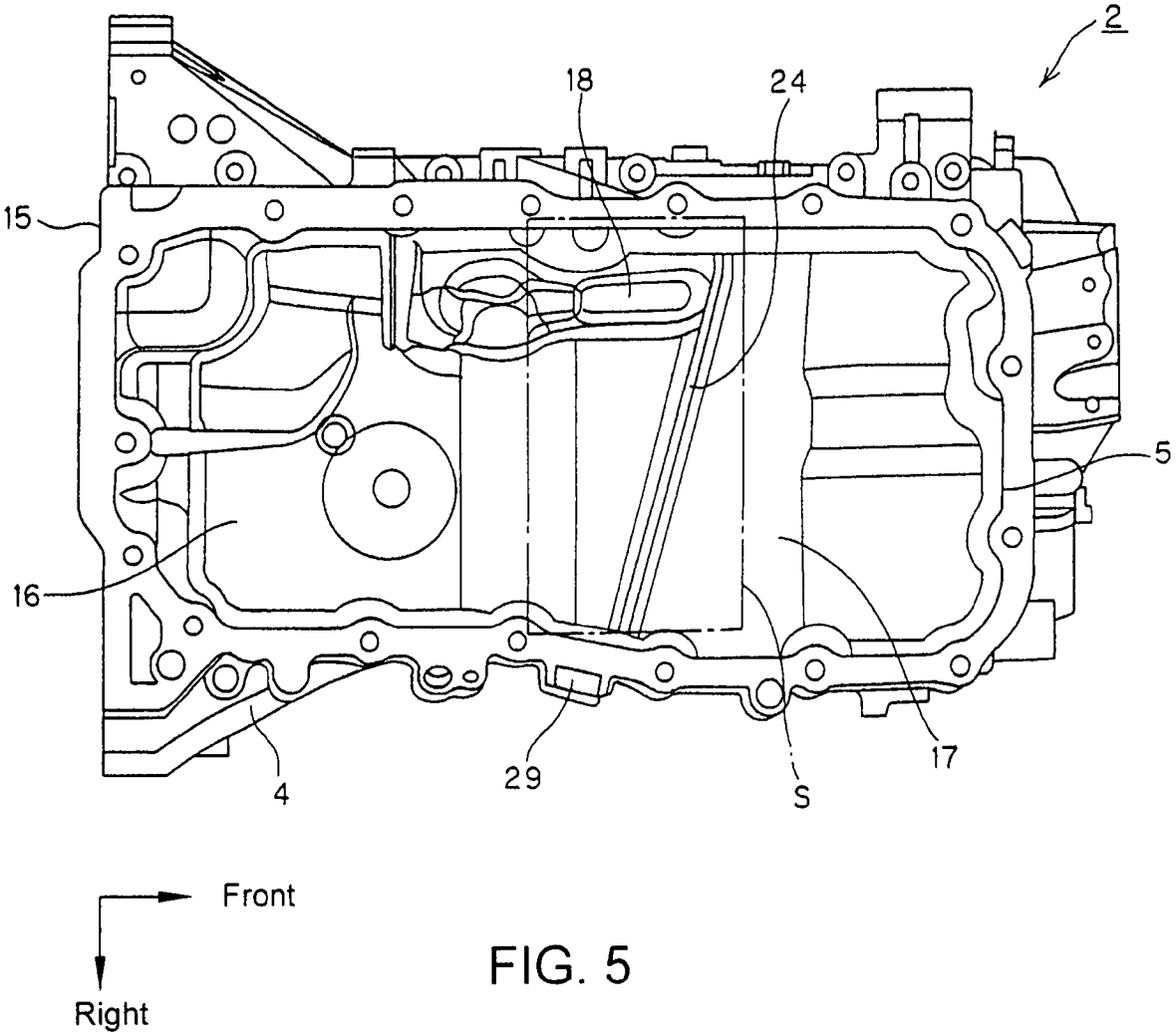
FIG. 5 is a bottom view of the engine to which the oil pan has been mounted.

In this configuration, recessed portion 18 for prevention of interference with a differential (not shown) is formed in a lower portion of a side face of the shallow bottom section 17 of the oil pan 5 as shown in FIG. 1, FIG. 5, and FIG. 7.

This recessed portion 18 for prevention of interference is formed at an angle where a side wall of the oil pan 5 crosses a bottom wall thereof with the angular portion from the shallow bottom section 17 to the deep bottom section 16 recessed inward as shown in FIG. 1, FIG. 5, and FIG. 7. Therefore the recessed portion 18 contributes not only to prevention of interference, but also to improvement in strength of the bottom section of the oil pan 5.

An oil level of a lubrication oil stored in the oil pan 5 can be raised by the recessed portion 18 for prevention of interference protruding into the oil pan 5. The recessed portion also contributes to reduction of a quantity of used lubrication oil, and also to improvement in output efficiency when a vehicle is running because of reduction of a total weight of the engine.

Figure 4:
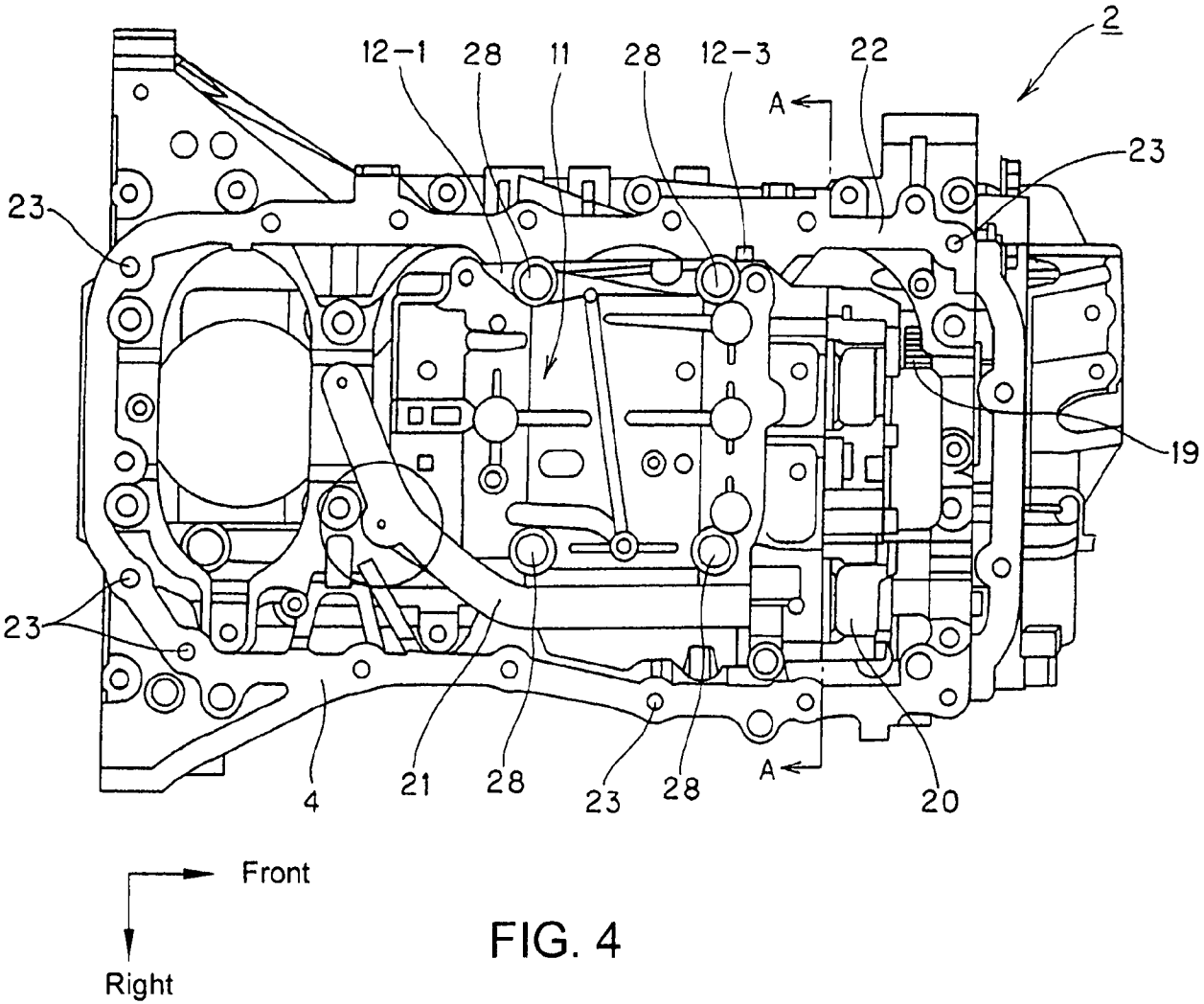
FIG. 4 is a bottom view of the engine from which the oil pan has been removed.

As shown in FIG. 3 and FIG. 4, the balancer device 11 is provided at a lower portion of the lower case 4, and a chain 19 for delivering a driving force is provided at another side of the balancer device 11 (at the right side in FIG. 3 and FIG. 4). Furthermore, an oil pump case 20 is provided at an inner portion from the position where the chain 19 is provided.

As shown in FIG. 3 and FIG. 4, an end portion in the discharge side of the oil strainer 21 is connected to oil pump case 20, and the oil strainer 21 extends near and under the balancer device 11. In addition, an end portion in the sucking side of the oil strainer 21 is provided in the deep bottom section 16 of the oil pan 5.

In this configuration, because an intermediate portion of the oil strainer 21 extends near and under the balancer device 11 to bypass the balancer 11, the intermediate portion of the oil strainer can efficiently be provided in the shallow bottom section 17 of the oil pan 5 which is a narrow and small space, which contributes to space reduction inside the oil pan 5 and makes it possible to ensure a space for provision of other components under the shallow bottom section 17 of the oil pan 5.

The oil pan 5 is mounted on a joining surface 22 formed in a lower portion of the lower case 4 as shown in FIG. 2, via the flange section 13 of the oil pan 5 as shown in FIG. 4.

In this configuration, as shown in FIG. 1 and FIG. 4 to FIG. 7, a plurality of joining surface side mounting holes 23 are provided with an even space in between on the joining surface 22 of the lower case 4. Bolts (not shown) penetrating the joining sections 14 provided on the flange section 13 of the oil pan 5 are set in the mounting holes 23 for tightening, respectively. Because of the configuration, the oil pan 5 can be attached tightly to the lower case 4, which enables improvement of the rigidity in the support of the oil pan 5.

On the other hand, in the flange section 13 of the oil pan 5, the transmission joining section 15 is formed in the deep bottom section 16 as shown in FIG. 1, FIG. 3, FIG. 5, and FIG. 7, so that the side of the oil pan 5 with the deep bottom section 16 provided therein can be more tightly supported and fixed, which contributes to improvement of the rigidity in support of the side of the oil pan 5 with the deep bottom section 16 provided therein, in which a large quantity of a lubrication oil is stored.

In addition, a reinforcing rib 24 having a horseshoe-shaped form and surrounding the balancer device 11 is formed on an external side face of the oil pan 5, and both end portions of the reinforcing rib 24 are coupled to a position adjoining the mounting section 12 provided to the side close to the lower case 4 of the flange section 13 joined to the first and second side walls 7 and 8.

To describe in more detail, as shown in dotted line in FIG. 1, the reinforcing rib 24 connects the flange sections 13 of the oil pan 5 facing against each other with the balancer device in between and adjoining input points of vibrations.

Because of the configuration, it is possible to reduce noise generated by the engine 1 by suppressing vibrations of side walls of the lower case 4 and those of the oil pan 5.

Since the reinforcing rib 24 is formed on, or monolithic with an external side face of the oil pan 5, it is possible to reduce a surface area of the oil pan 5 by making shallower a depth of the oil pan provided under the balancer device 11, and to reduce noises generated by the engine 1 in association with vibrations of side walls of the oil pan 5.

Furthermore, the reinforcing rib 24 crosses the recessed portion 18 for preventing interference at a position close to a bottom portion of the oil pan 5. Because of the feature, deformation of the reinforcing rib 24 can be suppressed by the recessed portion 18 for prevention of interference by having high rigidity, and noise caused by vibrations of the side walls of the lower case 4, as well as of side walls of the oil pan 5, can effectively be reduced.

Furthermore, the mounting sections 12 are provided at four points surrounding the balancer device 11, and the reinforcing rib 24 is provided in a range surrounded by the 4 mounting sections 12.

In a case where the engine 1 has 4 cylinders, the plurality of bearing cap sections 9 for connection between the first and second side walls 7, 8 of the lowercase 4 comprise 5 bearing cap sections 9, namely first to fifth bearing cap sections 9*a*, 9*b*, 9*c*, 9*d*, and 9*e* as shown in FIG. 6.

In each of the first to fifth bearing cap sections 9*a*, 9*b*, 9*c*, 9*d*, and 9*e*, bearing cap bolt insertion holes 25 are formed with a central line of the crank shaft 6 in between and also at an even space therefrom, respectively.

As shown in FIG. 6, a first mounting section 12-1 is provided between the third bearing cap section 9*c* provided at a position in a central portion of the lower case 4 and the first side wall 7 in an upper position of the lower case 4 as shown in FIG. 6.

A second mounting section 12-2 is provided, as shown in FIG. 6, between the third bearing cap section 9*c* and the second side wall 8 provided at a position in a lower portion of the lower case 4 in FIG. 6.

A third mounting section 12-3 is provided, as shown in FIG. 6, between the fourth bearing cap section 9*d* provided at the right side of the third bearing cap 9*c* shown in FIG. 6 and the first side wall 7 provided in an upper portion of the lower case 4.

A fourth mounting section 12-4 is provided, as shown in FIG. 6, between the fourth bearing cap section 9*d* and the second side wall 8 provided in a lower portion of the lower case 4.

Namely, the mounting section 12 comprises the first to fourth mounting sections 12-1, 12-2, 12-3, and 12-4, and the balancer 11 is provided in a range surrounded by the first to fourth mounting sections 12-1, 12-2, 12-3, and 12-4. Therefore, the first to fourth mounting sections 12-1, 12-2, 12-3, and 12-4 surround the balancer device 11.

When the balancer device 11 is provided in the mounting section 12, as shown in FIG. 1 to FIG. 3, four mounting bosses 27 for the balancer device 11 are positioned on the four mounting sections 26, namely the first to fourth mounting sections 12-1, 12-2, 12-3, and 12-4, and bolts 28 are inserted into the bosses 27 respectively to set the bolts 28 on the first to fourth mounting sections 12-1, 12-2, 12-3, and 12-4.

Because of the configuration, the balancer device 11 can be mounted on the lower case 4 with the four mounting sections, namely the first to fourth mounting sections 12-1, 12-2, 12-3, and 12-4 surrounding the balancer device. Since the balancer device 11 is mounted on the lower case 4 with the first to fourth mounting sections 12-1, 12-2, 12-3, and 12-4 from the outside, the easiness in mounting the balancer device 11 on the lower case 4 is improved, and also the rigidity in support of the balance device 11 is ensured.

Furthermore, the reinforcing rib 24 is provided in a range surrounded by the first to fourth mounting sections 12-1, 12-2, 12-3, and 12-4, namely in the range surrounded by four bosses for the balancer device 11 as indicated by the chain line shown in FIG. 1 and FIG. 5.

In the configuration, when the first to fourth mounting sections 12-1, 12-2, 12-3, and 12-4 are positioned as represented by the chain line in FIG. 1, the reinforcing rib 24 is formed on an external side face of the oil pan 5 for connecting the third mounting section 12-3 to the second and fourth mounting sections 12-2 and 12-4 (Refer to the portion indicated by the dotted line in FIG. 1).

Because of the feature described above, by providing the reinforcing rib 24 in the range surrounded by the first to fourth mounting sections 12-1, 12-2, 12-3, and 12-4, vibrations of the lower case 4 and the oil pan 5 can efficiently be suppressed. Therefore, vibrations can be suppressed with a small number of ribs, and it is possible to secure a space for providing components around the oil pan 5 and also to reduce a weight of the oil pan 5.

When the reinforcing rib 24 is provided on an external surface of the oil pan 5, the reinforcing rib 24 is formed in a direction not parallel nor perpendicular to the longitudinal and lateral directions of the oil pan 5, namely in the diagonal direction. Therefore, when the engine 1 is mounted in a vehicle in a direction along the longitudinal direction or the lateral direction of the vehicle, the engine can effectively respond to a force loaded to the vehicle in the longitudinal or the lateral direction of the vehicle, so that the rigidity of the oil pan 5 is improved and deformation of the oil pan 5, such as distortion thereof, can effectively be prevented. The reinforcing rib 24 can also respond to an external force from under the oil pan 5.

Furthermore, as shown in FIG. 1, a machining reference section 29 protrudes outwardly toward the flange section 13.

The machining reference section 29 is provided at a position adjoining the position where the reinforcing rib 24 is joined to the flange section 13.

As represented by the dotted line in FIG. 1, the reinforcing rib 24 is provided to connect the third mounting section 12-3 to the second and fourth mounting sections 12-2, 12-4, and the machining reference section 29 protruding outward is provided in the flange section 13 between the second and fourth mounting sections 12-2 and 12-4.

The machining reference position 29 is provided adjoining the position where the reinforcing rib 24 is joined to the flange section 13 and also along an external periphery of the flange section 13.

Because of the configuration, it is possible to suppress deformation of the flange section 13 with the reinforcing rib 24 connected thereto with the machining reference position 29 and also to reduce vibrations generated by the engine 1.

What is claimed is:

1. An engine oil pan structure comprising:

a lower case having a pair of side walls each extending in a longitudinal direction of a crank shaft and a plurality of bearing cap sections for connection between the side walls, said lower case provided under a cylinder block;

a balancer device having a balancer shaft provided under the lower case, said balancer device mounted on a mounting section formed at positions of the bearing cap sections adjoining the side walls respectively; and an oil pan covering the balancer device, said oil pan joined to lower end portions of the side walls;

wherein said oil pan has a deep bottom portion and a shallow bottom portion whose depth is shallower than that of said deep bottom portion;

said mounting section is provided inside of said shallow bottom portion; and a reinforcing rib which surrounds said balancer device in a horseshoe shape and whose two end portions are joined to portions of a flange section for joining the oil pan to the side walls adjoining the mounting section is provided on an external surface of said shallow bottom portion.

2. The engine oil pan structure according to claim 1, wherein the mounting section comprises four mounting sections surrounding the balancer device, and the reinforcing rib is provided in a range surrounded by the four mounting sections.

3. The engine oil pan structure according to claim 2, wherein said four mounting sections are provided in the two bearing cap sections adjoining in the longitudinal direction of the crank shaft among said bearing cap sections, and said reinforcing rib is provided so as to obliquely cross said crank shaft.

4. The engine oil pan structure according to claim 1, further comprising a machining reference section provided on the flange section and protruding outwardly, wherein the machining reference section is provided at a position adjoining the joining section of the reinforcing rib to the flange section.

5. The engine oil pan structure according to claim 1, wherein said oil pan is joined to lower end portions of the side walls of the lower case at an upper flange, and the upper flange is substantially planar.

* * * * *